US007784527B2

(12) United States Patent
Mizoguchi et al.

(10) Patent No.: US 7,784,527 B2
(45) Date of Patent: Aug. 31, 2010

(54) CONTINUOUS CASTING METHOD OF STEEL

(75) Inventors: Toshiaki Mizoguchi, Tokai (JP); Masanobu Hayakawa, Tokai (JP); Yoshiaki Suematsu, Tokai (JP); Akira Mikasa, Tokai (JP)

(73) Assignee: Nippon Steel Corporation, Tokyo (JP)

( * ) Notice: Subject to any disclaimer, the term of this patent is extended or adjusted under 35 U.S.C. 154(b) by 315 days.

(21) Appl. No.: 11/991,437

(22) PCT Filed: Sep. 5, 2006

(86) PCT No.: PCT/JP2006/317929

§ 371 (c)(1),
(2), (4) Date: Mar. 3, 2008

(87) PCT Pub. No.: WO2007/029840

PCT Pub. Date: Mar. 15, 2007

(65) Prior Publication Data

US 2009/0266505 A1 Oct. 29, 2009

(30) Foreign Application Priority Data

Sep. 5, 2005 (JP) ..... 2005-256605

(51) Int. Cl.
*B22D 27/02* (2006.01)
*B22D 11/115* (2006.01)

(52) U.S. Cl. ..... 164/468; 164/504

(58) Field of Classification Search ..... None
See application file for complete search history.

(56) References Cited

U.S. PATENT DOCUMENTS 6,675,996 B1 1/2004 Miyamoto et al.

FOREIGN PATENT DOCUMENTS

FR 2 500 773 9/1982

(Continued)

OTHER PUBLICATIONS

Taiwan Office Action dated Feb. 25, 2009 issued in corresponding Taiwan Application No. 095132696.

(Continued)

*Primary Examiner*—Kuang Y Lin
*Assistant Examiner*—Steven Ha
(74) *Attorney, Agent, or Firm*—Kenyon & Kenyon LLP

(57) ABSTRACT

The present invention provides a continuous casting method of steel preventing alumina and other nonmetallic inclusions becoming causes of slivers and argon bubbles becoming causes of blowholes from being entrained and thereby enabling the production of a cast slab superior in surface and internal quality, that is, one giving an inside bore 21 of an immersion nozzle 21 a horizontal sectional shape of an elliptical shape or oblong shape with a length ratio $D_L/D_S$ of that long axis $D_L$ and short axis $D_S$ of 1.2 to 3.8, making a direction of that long axis substantially parallel to a long side direction of the casting mold 3, and making the sliding direction of the sliding nozzle 1 a direction perpendicular to said long axis to supply the molten steel in the casting mold 3. Note that a ratio $S_1/S_0$ of a sectional area $S_1$ at a smallest sectional area part 23 of the inside bore 21 and a sectional area $S_0$ of a nozzle hole 11 of the sliding nozzle 1 is made 0.5 to 0.95

4 Claims, 3 Drawing Sheets

FOREIGN PATENT DOCUMENTS

| | | |
|---|---|---|
| JP | 58-074257 | 5/1983 |
| JP | 07-016715 | 1/1995 |
| JP | 09-108793 | 4/1997 |
| JP | 09-225604 | 9/1997 |
| JP | 09-285852 | 11/1997 |
| JP | 11-47897 | 2/1999 |
| JP | 2000-237852 | 9/2000 |
| JP | 2002-301549 A | 10/2002 |
| JP | 2002-346706 | 12/2002 |
| JP | 2003-164947 A | 6/2003 |

OTHER PUBLICATIONS

European Search Report dated Sep. 17, 2009, issued in corresponding European Patent Application No. 06797755.3.

PRIOR ART

CONTINUOUS CASTING METHOD OF STEEL

TECHNICAL FIELD

The present invention relates to a continuous casting method of steel for stably producing a cast slab superior in surface and internal quality.

BACKGROUND ART

Various technologies have been developed in the past for stabilizing the discharge flow of molten steel from an immersion nozzle so as to produce a cast slab having excellent surface and internal quality. Japanese Patent Publication (A) No. 2002-301549 discloses a continuous casting method preventing the phenomenon of single-sided flow of molten steel in the casting mold by setting an angle between a sliding nozzle and horizontal plane formed by the discharge flow to 80 to 90°. Japanese Patent Publication (A) No. 58-74257 discloses an injection method making the immersion nozzle a rectangular cross-section and casting while holding the injection flow from the injection nozzle to the casting mold at a uniform low speed descending flow. Japanese Patent Publication (A) No. 9-285852 discloses a continuous casting method making the discharge hole a slit shape and dispersing and making uniform the flow of molten steel discharged from an immersion nozzle so as to produce a cast slab free from surface and internal defects.

Japanese Patent Publication (A) No. 2000-237852 discloses an immersion nozzle provided inside it with a twisted tape shaped rotating blade. Japanese Patent Publication (A) No. 9-225604 discloses a continuous casting method introducing inert gas into an immersion nozzle and controlling the internal pressure so as to prevent the occurrence of a biased flow in the flow of the molten steel from the discharge hole. Japanese Patent Publication (A) No. 9-108793 discloses a continuous casting method using an immersion nozzle with a front end enlarged in inside diameter compared with the inside diameter of the base end of the immersion nozzle.

However, even with these methods, it was still difficult to stabilize the flow of molten steel discharged into the casting mold. It was not possible to sufficiently prevent surface defects called "slivers" due to inclusions occurring at the coil surface after rolling or bubble defects called "blowholes" due to argon blown from the immersion nozzle.

DISCLOSURE OF THE INVENTION

The present invention provides a continuous casting method of steel eliminating the above problems of the prior art by stabilizing a discharge flow from an immersion nozzle so as to prevent alumina and other nonmetallic inclusions becoming causes of slivers and argon bubbles becoming causes of blowholes from being entrained and thereby enabling the production of a cast slab superior in surface and internal quality.

The inventors analyzed the flow inside an immersion nozzle so as to solve the above problems and as a result obtained the following discovery and completed the present invention. That is, in the case of a conventional type of immersion nozzle where the nozzle inside bore has a circular horizontal sectional shape, as shown in FIG. 4, if making the sliding nozzle 1 slide, the opening part will become biased to one side, so a swirl flow heading in the sliding direction of the sliding nozzle 1 will be formed in the immersion nozzle 2. Due to this swirl flow, the fluctuation in flow rate of the molten steel from the immersion nozzle discharge hole is increased and the largest discharge flow rate increases.

It was learned that the increase in the largest flow rate causes the depth of penetration of the discharge flow to increase, so the deoxidation products of alumina, continuous casting powder, and other inclusions or the argon bubbles blown from the immersion nozzle penetrate deeply inside the cast slab and remain there without floating up, thereby leading to surface defects at the thin sheets, cracking at the time of pressing or can-making, and other internal defects.

The inventors discovered that to prevent this swirl flow, it is effective to give the nozzle inside bore a horizontal sectional shape of an elliptical shape or oblong shape or other flat shape, make the direction of that long axis substantially parallel to a long side direction of the casting mold, and make the sliding direction of the sliding nozzle a direction perpendicular to said long axis in casting. Conversely, it was learned that by making direction of the long axis of the elliptical shape etc. substantially perpendicular to the long side direction of the casting mold and making the sliding direction of the sliding nozzle a direction parallel to said long axis, the swirl flow is assisted and the largest discharge flow rate is increased and as a result the harmful defect occurrence rate increases.

The continuous casting method of steel of the present invention made based on the above discoveries is a continuous casting method of steel supplying molten steel from a sliding nozzle provided at a bottom of a tundish through an immersion nozzle to the inside of a casting mold, characterized by giving an inside bore of the immersion nozzle a horizontal sectional shape of an elliptical shape or oblong shape, making a length ratio $D_L/D_S$ of that long axis $D_L$ and short axis $D_S$ 1.2 to 3.8, making a direction of that long axis substantially parallel to a long side direction of the casting mold, and making the sliding direction of the sliding nozzle a direction perpendicular to said long axis to supply the molten steel in the casting mold.

In the above invention, it is preferable to make a ratio $S_1/S_0$ of a sectional area $S_1$ at a smallest sectional area part of the immersion nozzle inside bore and a sectional area $S_0$ of a nozzle hole of the sliding nozzle 0.5 to 0.95, further, it is preferable to provide two discharge holes at the two sides of the immersion nozzle in the long axis direction so that the discharge holes of the immersion nozzle discharge molten steel toward the short side direction of the facing casting mold, and, further, it is preferable to make a distance between an outer surface of the short axis side of the immersion nozzle and the inner wall of the long length side of the casting mold at least 50 mm. Further, in the above invention, it is preferable to cast the molten steel while using an electromagnetic stirring device to impart swirl ability to the steel in the casting mold.

BEST MODE FOR CARRYING OUT THE INVENTION

Below, the best mode for carrying out the present invention will be explained.

Figure 1:
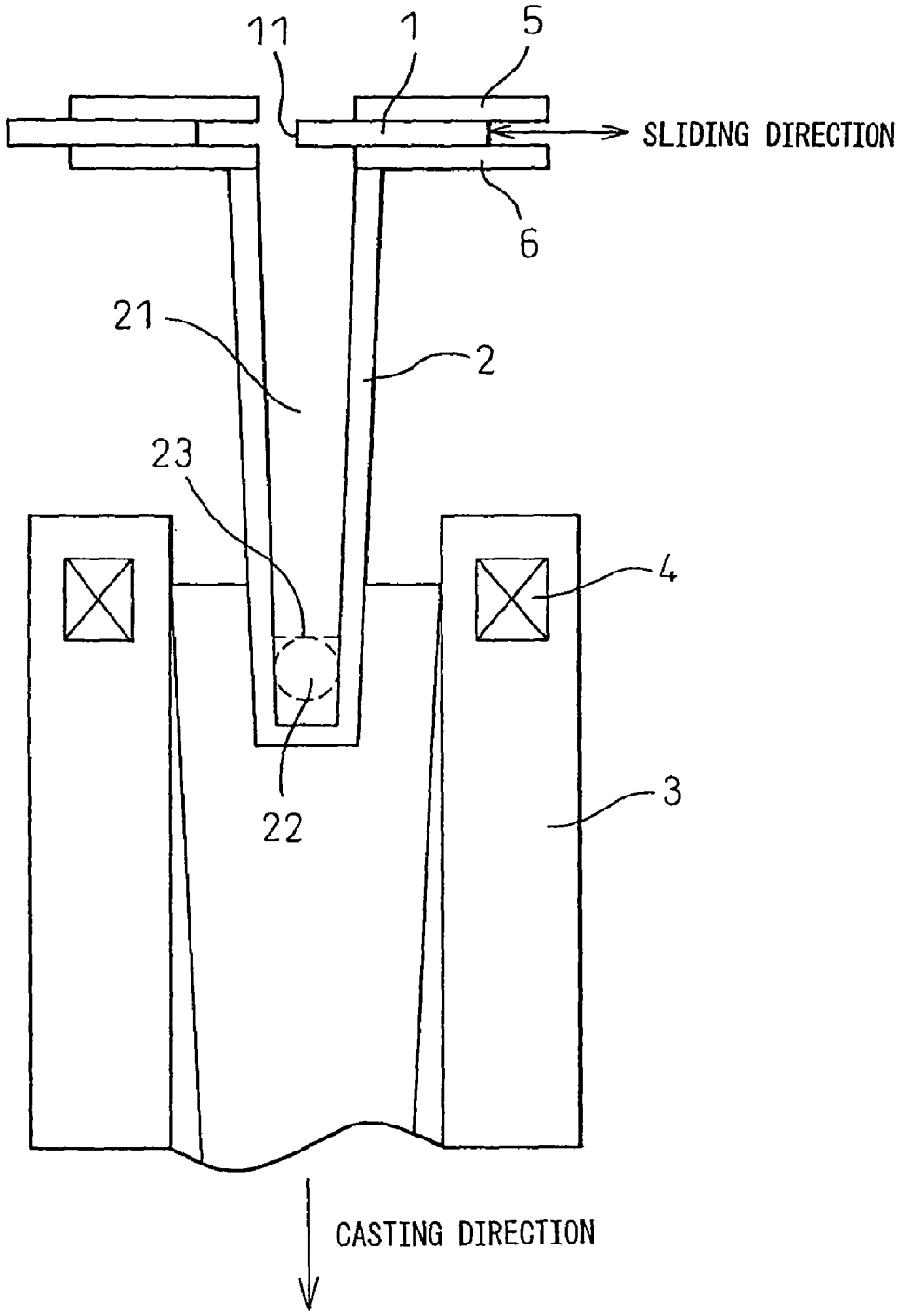
FIG. 1 is a sectional view of a casting mold provided with an immersion nozzle according to the present invention as seen from a short side.

FIG. 1 is a view showing the general configuration of a continuous casting facility for working the continuous casting method of the present invention as seen from the short side of the cast slab, wherein 1 indicates a sliding nozzle provided at the bottom of a not shown tundish, 2 an immersion nozzle connected to the sliding nozzle 1, 3 a casting mold into which the molten steel is injected, and 4 an electromagnetic stirring coil stirring the molten steel in the casting mold. The sliding nozzle 1 has a nozzle hole 11 with a sectional area $S_0$ and slides sandwiched between an upper plate 5 and a lower plate 6.

Figure 2:
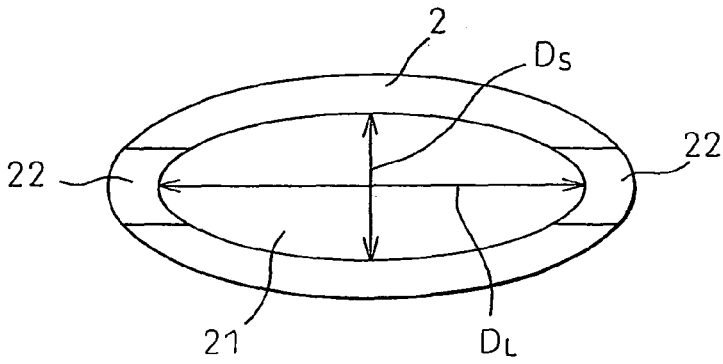
FIG. 2 is a horizontal sectional view of an immersion nozzle according to the present invention.
Figure 3:
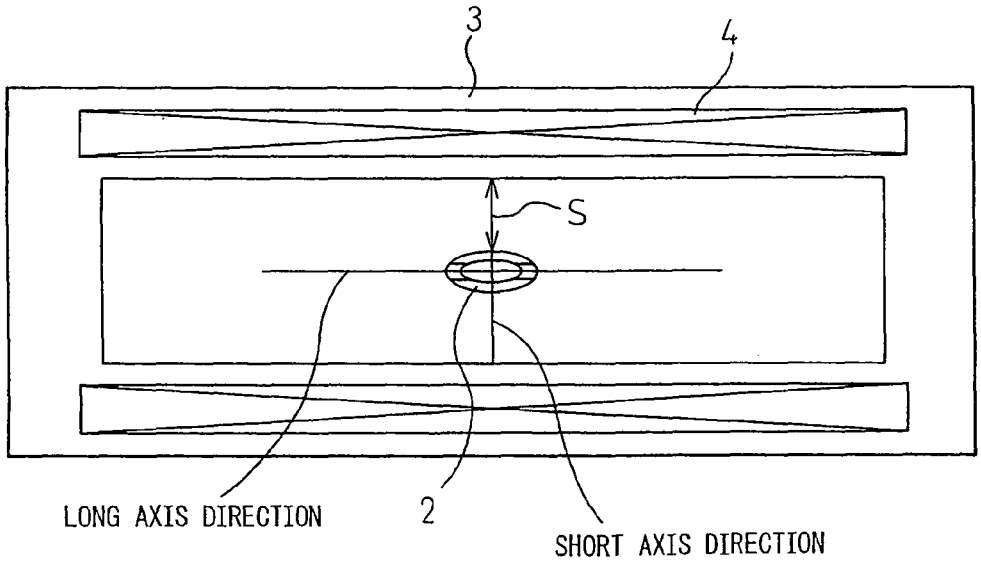
FIG. 3 is a plan view of a casting mold.
Figure 4:
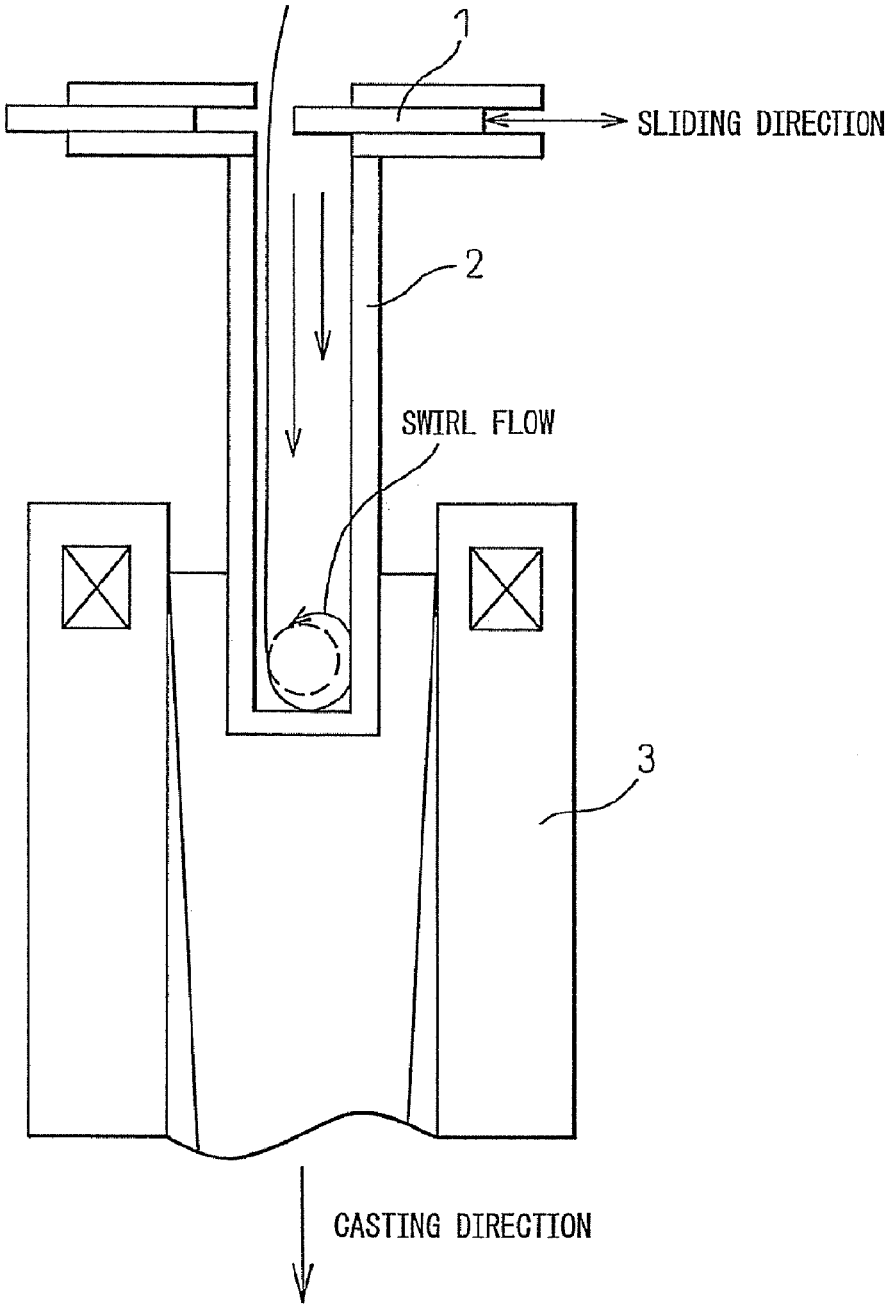
FIG. 4 is a sectional view of a casting mold provided with a conventional immersion nozzle as seen from the short side.

In the present invention, an inside bore 21 of the immersion nozzle 2 is circular at the top, but is elliptical shaped as shown in FIG. 2 at the bottom. An "elliptical shape" includes an extended elliptical shape. Further, instead of an elliptical shape, it is also possible to use an oblong shape having a parallel part where the rectangular short length sides are replaced with arcs. The elliptical shape or oblong shape has a long axis $D_L$ and a short axis $D_S$ perpendicular to the same. The long axis $D_L$, as shown in FIG. 3, is considered parallel or substantially parallel to the long side of the casting mold 3. Therefore, the short axis $D_S$ is perpendicular or substantially perpendicular to the long side of the casting mold 3. Further, the immersion nozzle 2 is provided with two discharge holes 22 at the two sides in the long axis $D_L$ direction, so the two discharge holes 22 can discharge molten steel toward the short side direction of the casting mold 3 which they face. Further, the sliding direction of the sliding nozzle 1 is made a direction perpendicular to the long axis $D_L$, so it is possible to keep down the width in the direction of swirl of the molten steel inside the immersion nozzle 2 and make the molten steel flow in the long axis $D_L$ direction and possible to make the swirl flow of the molten steel occurring when sliding the sliding nozzle 1 small.

In the immersion nozzle 2 having the inside bore 21 of the above shape, the length ratio $D_L/D_S$ of the long axis $D_L$ and the short axis $D_S$ has to be made 1.2 to 3.8 right above the discharge hole 22. With a length ratio $D_L/D_S$ of less than 1.2, the occurrence of a swirl flow in the sliding direction of the sliding nozzle 1 cannot be effectively prevented, while if over 3.8, the molten steel is not uniformly filled in the cast slab width direction in the immersion nozzle 2 and the flow rate of molten steel from the discharge hole 22 will not become uniform.

The immersion nozzle 2 is reduced in sectional area of the inside bore 21 from the top to the bottom, but the ratio $S_1/S_0$ of the sectional area $S_1$ of the part right above the discharge hole 22, that is, the sectional area $S_1$ at the smallest sectional area part 23 of the inside bore 21, and the sectional area $S_0$ of the nozzle bore 11 of the sliding nozzle 1 is preferably made 0.5 to 0.95. With this ratio $S_1/S_0$ less than 0.5, the inside of the immersion nozzle 2 becomes easily filled by molten steel, the inside of the immersion nozzle 2 becomes a negative pressure, and intake of air from the engagement part of the immersion nozzle 2 and the bottom nozzle 6 occurs. As a result, the Al in the molten steel and the air react and a large amount of alumina is produced, so nozzle clogging easily occurs and stable operation becomes no longer possible. On the other hand, with a ratio $S_1/S_0$ of over 0.95, the flatness of the inside bore 21 is small and the occurrence of a swirl flow in the sliding direction of the sliding nozzle 1 inside the immersion nozzle 2 cannot be effectively prevented.

Furthermore, as shown in FIG. 3, the distance S between the outer surface of the short axis side of the immersion nozzle 2 and the inner wall of the long side of the casting mold 3 is preferably made 50 mm or more. If the distance S is less than 50 mm, a sufficient flow rate of molten steel cannot be obtained when trying to electromagnetically stir the molten steel, so inclusions etc. causing surface defects end up being trapped.

Further, in the present invention, it is possible to use an electromagnetic stirring coil 4 or other electromagnetic stirring device to impart swirl ability to the molten steel in the casting mold 3 while casting. By electromagnetically stirring the molten steel, it is possible to prevent inclusions etc. from being trapped in the cast slab and produce a cast slab superior in surface properties.

EXAMPLES

Below, the present invention will be explained in detail based on the examples.

300 tons of molten steel of an ultralow carbon steel were produced by a converter-RH process. The temperature of the molten steel in the tundish was made 1560 to 1580° C., a three-layer type sliding nozzle and immersion nozzle were used to inject the molten steel into the casting mold, and a cast slab of a thickness of 250 mm and a width of 1200 to 1600 mm was cast at a casting rate of 1.6 to 2.0 mm/min. In the casting, the molten steel was made to swirl by electromagnetic stirring in the horizontal direction. Next, the cast slab was hot rolled, pickled, cold rolled, and annealed by ordinary methods to obtain 0.7 to 1.2 mm cold rolled steel sheets.

The results of continuous casting and testing under various conditions are shown in Table 1. In the table, A1 to A20 are examples of the present invention, while B1 to B13 are comparative examples. Note that the notes ★1 to ★8 in the table mean the following ★1. Horizontal sectional shape of inside bore of immersion nozzle, shows shape at smallest sectional area position.

★2. "Perpendicular" means long axis direction of elliptical cross-section of immersion nozzle and sliding direction of sliding nozzle are substantially perpendicular, while "parallel" means long axis direction of elliptical cross-section of immersion nozzle and sliding direction of sliding nozzle are substantially parallel.

★3. "Parallel" means long axis direction of the elliptical cross-section of the immersion nozzle is substantially parallel to the long side direction of the casting mold, while "perpendicular" means the long axis direction of the elliptical cross-section of the immersion nozzle is substantially perpendicular to the long side direction of the casting mold.

★4. $S_1$ is the smallest sectional area of the immersion nozzle hole part, while $S_0$ is the horizontal sectional area of the sliding nozzle.

★5. A "two-hole" nozzle supplies molten steel to the short side direction of the casting mold, a "downward" nozzle supplies it downward by a single hole, and a "slit" nozzle is formed at the bottom end of the nozzle and supplies it toward the bottom so that it becomes parallel to the long axis direction of the elliptical cross-section of the immersion nozzle.

★6. Smallest distance between outer wall of immersion nozzle and inner wall of long side of casting mold.

★7. Rate of occurrence of blistering at cold rolled steel sheet. Rate of occurrence of blistering (%)=number of coils were blistering occurred/total number of investigated coils× 100.

★8. The rate of occurrence of slivers in cold rolled steel sheet. Sliver occurrence rate (%)=sliver total length (m)/total length of investigated coils ×100.

TABLE 1

| Class | No. | Immersion nozzle sectional shape *1 Long axis length $lD_L$ (mm) | Short axis length $D_s$ (mm) | Length ratio $D_L/D_s$ | SN sliding direction *2 | Positional relationship with casting mold *3 | Sectional area ratio $S_1/S_0$ with SN *4 | Discharge hole shape *5 | Immersion nozzle/casting mold distance *6 (mm) | Coil quality, blistering rate (%) *7 | Surface defect rate (%) *8 | Immersion nozzle clogging |
|---|---|---|---|---|---|---|---|---|---|---|---|---|
| Inv. Ex. | A1 | 93 | 76 | 1.2 | Perpendicular | Parallel | 0.88 | 2 holes | 55 | 0.5 | 0 | None |
| Inv. Ex. | A2 | 108 | 65 | 1.7 | Perpendicular | Parallel | 0.92 | 2 holes | 65 | 0.2 | 0.08 | None |
| Inv. Ex. | A3 | 120 | 53 | 2.3 | Perpendicular | Parallel | 0.92 | 2 holes | 75 | 0 | 0.06 | None |
| Inv. Ex. | A4 | 124 | 49 | 2.5 | Perpendicular | Parallel | 0.92 | 2 holes | 85 | 1.8 | 0 | None |
| Inv. Ex. | A5 | 136 | 36 | 3.8 | Perpendicular | Parallel | 0.91 | 2 holes | 95 | 1.1 | 0.13 | None |
| Inv. Ex. | A6 | 93 | 76 | 1.2 | Perpendicular | Parallel | 0.56 | 2 holes | 55 | 0 | 0 | None |
| Inv. Ex. | A7 | 108 | 65 | 1.7 | Perpendicular | Parallel | 0.59 | 2 holes | 65 | 0.7 | 0 | None |
| Inv. Ex. | A8 | 120 | 53 | 2.3 | Perpendicular | Parallel | 0.59 | 2 holes | 75 | 0.4 | 0.07 | None |
| Inv. Ex. | A9 | 124 | 49 | 2.5 | Perpendicular | Parallel | 0.59 | 2 holes | 85 | 1.3 | 0 | None |
| Inv. Ex. | A10 | 136 | 36 | 3.8 | Perpendicular | Parallel | 0.58 | 2 holes | 95 | 0.2 | 0.12 | None |
| Inv. Ex. | A11 | 102 | 84 | 1.2 | Perpendicular | Parallel | 0.86 | 2 holes | 55 | 0 | 0 | None |
| Inv. Ex. | A12 | 119 | 72 | 1.7 | Perpendicular | Parallel | 0.91 | 2 holes | 65 | 0 | 0.14 | None |
| Inv. Ex. | A13 | 132 | 58 | 2.3 | Perpendicular | Parallel | 0.91 | 2 holes | 75 | 0.3 | 0 | None |
| Inv. Ex. | A14 | 136 | 54 | 2.5 | Perpendicular | Parallel | 0.91 | 2 holes | 85 | 1.4 | 0.11 | None |
| Inv. Ex. | A15 | 150 | 40 | 3.8 | Perpendicular | Parallel | 0.89 | 2 holes | 95 | 0.6 | 0.08 | None |
| Inv. Ex. | A16 | 82 | 67 | 1.2 | Perpendicular | Parallel | 0.87 | 2 holes | 55 | 0.9 | 0 | None |
| Inv. Ex. | A17 | 95 | 57 | 1.7 | Perpendicular | Parallel | 0.91 | 2 holes | 65 | 0 | 0 | None |
| Inv. Ex. | A18 | 106 | 47 | 2.3 | Perpendicular | Parallel | 0.91 | 2 holes | 75 | 1 | 0.06 | None |
| Inv. Ex. | A19 | 109 | 43 | 2.5 | Perpendicular | Parallel | 0.91 | 2 holes | 85 | 0 | 0.08 | None |
| Inv. Ex. | A20 | 120 | 32 | 3.8 | Perpendicular | Parallel | 0.9 | 2 holes | 95 | 0 | 0.08 | None |
| Comp. Ex. | B1 | 90 | 90 | 1 | — | — | 1 | 2 holes | 45 | 5.1 | 0.61 | None |
| Comp. Ex. | B2 | 100 | 100 | 1 | — | — | 1.23 | 2 holes | 25 | 4.5 | 0.42 | None |
| Comp. Ex. | B3 | 90 | 85 | 1.1 | Perpendicular | Parallel | 0.94 | 2 holes | 55 | 6.3 | 1.02 | None |
| Comp. Ex. | B4 | 150 | 35 | 4.3 | Perpendicular | Parallel | 1.06 | 2 holes | 95 | 5.8 | 0.43 | None |
| Comp. Ex. | B5 | 93 | 76 | 1.2 | Parallel | Parallel | 0.88 | 2 holes | 55 | 7.2 | 0.48 | None |
| Comp. Ex. | B6 | 136 | 36 | 3.8 | Parallel | Parallel | 0.91 | 2 holes | 95 | 7.7 | 0.76 | None |
| Comp. Ex. | B7 | 93 | 76 | 1.2 | Perpendicular | Perpendicular | 0.56 | 2 holes | 55 | 5.5 | 0.55 | None |
| Comp. Ex. | B8 | 136 | 36 | 3.8 | Perpendicular | Perpendicular | 0.58 | 2 holes | 95 | 4.8 | 0.82 | None |
| Comp. Ex. | B9 | 93 | 76 | 1.2 | Perpendicular | Parallel | 0.42 | 2 holes | 55 | 7.1 | 0.42 | Yes |
| Comp. Ex. | B10 | 136 | 36 | 3.8 | Perpendicular | Parallel | 1.16 | 2 holes | 95 | 6.2 | 0.49 | None |
| Comp. Ex. | B11 | 93 | 76 | 1.2 | Perpendicular | Parallel | 0.88 | 2 holes | 45 | 2.2 | 0.28 | None |
| Comp. Ex. | B12 | 136 | 36 | 3.8 | Perpendicular | Parallel | 0.91 | Downward | 55 | 7.5 | 0.32 | None |
| Comp. Ex. | B13 | 93 | 76 | 1.2 | Perpendicular | Parallel | 0.88 | Slit | 95 | 8.2 | 0.25 | None |

Comparative Examples B1 and B2 are cases using conventional immersion nozzles of circular cross-sections. Swirl flows occurred in the immersion nozzles, so alumina and other inclusions and argon bubbles failed to sufficiently float up and ended up remaining in the steel. As a result, these had high rates of occurrence of blistering and surface defects.

Comparative Example B3 had a length ratio $D_L/D_S$ of the nozzle cross-section of 1.1 or smaller than the lower limit of the present invention of 1.2. For this reason, again a swirl flow occurred inside the immersion nozzle, so this had high rates of occurrence of blistering and surface defects. Comparative Example B4 had a length ratio $D_L/D_S$ of 4.3 or larger than the upper limit of the present invention of 3.8. For this reason, the flow rate of molten steel from the discharge holes became uneven and the rates of occurrence of blistering and surface defects ended up becoming higher.

Comparative Examples B5 and B6 had suitable nozzle cross-sectional shapes, but the sliding directions of the sliding nozzles were made parallel to the long axis directions of the cross-sections of the inside bores of the immersion nozzles, so swirl flows ended up occurring in the immersion nozzles. Comparative Examples B7 and B8 ended up having long axes of the inside bores of the immersion nozzles made perpendicular to the long side directions of the casting molds, so the discharge flows became unstable and inclusions and bubbles were entrained. As a result, these ended up becoming higher in rates of occurrence of blistering and surface defects.

Comparative Example B9 had a ratio $S_1/S_0$ of the sectional area $S_1$ at the smallest sectional area part of the inside bore of the immersion nozzle and sectional area $S_0$ of the nozzle hole of the sliding nozzle smaller than the range of the present invention. For this reason, intake of air from the engagement part of the immersion nozzle and bottom nozzle occurred and as a result a large amount of alumina was produced and nozzle clogging ended up occurring. Comparative Example B10 had a ratio $S_1/S_0$ larger than the range of the present invention. For this reason, the occurrence of a swirl flow inside the immersion nozzle could not be effectively prevented and the rates of occurrence of blistering and surface defects ended up becoming higher.

Comparative Example B11 had a distance S between the outer surface of the short axis side of the immersion nozzle and the inner wall of the long side of the casting mold shorter than the 50 mm range of the present invention. For this reason, the flow rate of the molten steel near the immersion nozzle fell and inclusions and bubbles ended up being trapped by the cast slab, so the occurrence of blistering and surface defects became greater.

Comparative Example B12 provided a single discharge hole facing downward at the bottom of the immersion nozzle. Further, Comparative Example B13 formed a slit facing downward at the bottom end of the nozzle parallel to the long axis direction of the inside bore of the immersion nozzle. In each case, the discharge flow reached deep from the meniscus, the inclusions etc. were not able to sufficiently float up and be separated, and for that reason the rates of occurrence of blistering and surface defects ended up becoming higher. As compared with the above comparative examples, the examples of the present invention shown in A1 to A20 had suitable length ratios $D_L/D_S$ of the nozzle cross-sections and had ratios $S_1/S_0$ in suitable ranges as well, so the occurrence of swirl flows inside the immersion nozzles could be suppressed. Further, the sliding directions of the sliding nozzles and the directions of the long axes of the inside bores of the immersion nozzles relative to the long sides of the casting molds were suitable, the directions of the discharge holes of the immersion nozzles were also suitable, and the distances S between the outer surfaces of the immersion nozzles and the inner walls of the long sides of the casting molds were also sufficiently large. For that reason, the discharge flows never penetrated deeply from the meniscus and the flow rates of the molten steel near the immersion nozzles never dropped, so inclusions and bubbles could be made to sufficiently float up and be separated and as a result the rates of occurrence of blistering and surface flaws could be made 0 or extremely small.

INDUSTRIAL APPLICABILITY

The present invention makes the horizontal sectional shape of the immersion nozzle inside bore an elliptical or other flat shape, makes that long axis parallel to the long side of the casting mold, and makes the sliding direction of the sliding nozzle a direction perpendicular to said long axis, so the width in the direction of swirl of molten steel in the immersion nozzle is suppressed and the swirl flow of the molten steel can be made small. Further, it optimizes the ratio $S_1/S_0$ of the sectional area $S_1$ of the smallest part of the immersion nozzle inside bore and the sectional area $S_0$ of the bore part of the sliding nozzle and can prevent a swirl flow without causing nozzle clogging due to intake of air into the immersion nozzle. Further, two discharge holes are provided at the two sides of the immersion nozzle in the long axis direction, so it is possible to prevent the molten steel discharge flow from penetrating deeply from the meniscus. Further, the invention sets a suitable distance between the outer surface of the short axis side of the immersion nozzle and the inner surface of the long side of the casting mold, so it is possible to sufficiently secure the flow rate of molten steel near the immersion nozzle and cast the molten steel. Further, the invention uses electromagnetic stirring to make the molten steel fluid, so it is possible to prevent nonmetallic inclusions etc. from being trapped in the cast slab and to cast a cast slab superior in surface properties.

The invention claimed is:

1. A continuous casting method of steel supplying molten steel from a sliding nozzle provided at a bottom of a tundish through an immersion nozzle to the inside of a casting mold, said continuous casting method of steel characterized by giving a horizontal cross section of an inside bore of the immersion nozzle an elliptical shape having the ratio $S_1/S_0$ of 0.5 to 0.9, where $S_1$ is the sectional area of the smallest sectional area part of the inside bore, $S_0$ is the sectional area of the bore of the sliding nozzle, and making a length ratio of the inside bore of the immersion nozzle $D_L/D_s$ of a long axis $D_L$ and a short axis $D_s$ 1.2 to 3.8, making a direction of the long axis parallel to a long side direction of the casting mold, and making the sliding direction of the sliding nozzle a direction perpendicular to said long axis to supply the molten steel in the casting mold.

2. A continuous casting method of steel as set forth in claim 1, characterized in that two discharge holes are provided at the opposite long axis sides of the immersion nozzle so that the discharge holes of the immersion nozzle discharge molten steel toward the short side direction of the facing casting mold.

3. A continuous casting method of steel as set forth in claim 1, characterized in that a distance between an outer surface of the short axis side of the immersion nozzle and the inner wall of the long side of the casting mold is made at least 50 mm.

4. A continuous casting method of steel as set forth in claim 1, characterized by using an electromagnetic stirring apparatus to impart swirlability to the steel in the casting mold during casting.

* * * * *